US006138920A

United States Patent [19]

Ban et al.

[11] Patent Number: 6,138,920

[45] Date of Patent: Oct. 31, 2000

[54] VEHICLE HEATING SYSTEM AND A METHOD OF CONTROLLING THE SAME SYSTEM

[75] Inventors: Takashi Ban; Tatsuyuki Hoshino; Shigeru Suzuki; Tatsuya Hirose, all of Kariya, Japan

[73] Assignee: Kabushiki Kaisha Toyoda Jidoshokki Seisakusho, Kariya, Japan

[21] Appl. No.: 09/411,489

[22] Filed: Oct. 4, 1999

[30] Foreign Application Priority Data

Oct. 7, 1998 [JP] Japan ..... 10-285306

[51] Int. Cl.[7] ..... B60H 1/02

[52] U.S. Cl. ..... 237/12.3 R; 122/26; 126/247

[58] Field of Search ..... 237/12.3 B, 12.3 R; 126/247; 122/26; 123/142.5 R

[56] References Cited

U.S. PATENT DOCUMENTS

| | | | |
|---|---|---|---|
| 5,743,467 | 4/1998 | Ban et al. | 237/12.3 R |
| 5,901,670 | 5/1999 | Moroi et al. | 122/26 |
| 5,938,115 | 8/1999 | Aoki et al. | 237/12.3 R |
| 5,954,120 | 9/1999 | Aoki et al. | 165/43 |

FOREIGN PATENT DOCUMENTS

| | | | |
|---|---|---|---|
| 2-246823 | 10/1990 | Japan . | |
| 6-92134 | 5/1994 | Japan | 237/12.3 R |
| 10-114212 | 5/1998 | Japan . | |

*Primary Examiner*—Harold Joyce
*Assistant Examiner*—Derek S. Boles
*Attorney, Agent, or Firm*—Woodcock Washburn Kurtz Mackiewicz & Norris LLP

[57] ABSTRACT

A heating system incorporating a heat generator confining therein a heat-generative fluid to viscously generate heat when a shearing action is applied to the fluid by a rotor element, and a heat-generation controller including a heat-generation adjusting actuator which adjustably changes the heat-generating performance of the heat generator on the basis of a signal detected as a first control signal indicating a change in the rotating speed of the rotor element and a preset reference signal. A second control signal detected to indicate a temperature of the heat-generative fluid is used to adjustably change the preset reference signal. The operation of the heating system is controlled by a method in which the first control signal is compared with the preset reference signal to determine whether or not the heat-generation adjusting actuator should actuated to change the heat-generating performance of the heat generator. The method is performed so as to adjust the preset reference signal on the basis of the second control signal which is detected by a temperature sensor.

14 Claims, 6 Drawing Sheets

VEHICLE HEATING SYSTEM AND A METHOD OF CONTROLLING THE SAME SYSTEM

BACKGROUND OF THE INVENTION

1. Field of the Invention

The present invention relates to a heating system, not exclusively but preferably, used as a heating system for heating an objective heated area of a vehicle such as a passenger compartment. More particularly, the present invention relates to a vehicle heating system accommodating therein a viscous fluid type heat generator which employs viscous fluid to generate heat by the application of a shearing force thereto and transmits the heat to a circulating heat exchanging fluid, typically an engine coolant (cooling water), capable of carrying the heat to the objective heated area in the vehicle. The present invention also relates to a method of controlling the vehicle heating system.

2. Description of the Related Art

Japanese Unexamined Patent Publication (Kokai) No. 2-246823 (JP-A-2-246823) discloses a typical vehicle heating system in which a viscous fluid type heat generator, able to generate heat by using a viscous fluid frictionally generating heat when it is subjected to a shearing action, is incorporated.

The viscous fluid type heat generator disclosed in JP-A-2-246823 includes a pair of mutually opposing front and rear housings tightly secured together by appropriate tightening elements, such as through bolts, to define an inner heat generating chamber and a heat receiving chamber arranged around the heat generating chamber in the form of a water jacket. The heat-generating chamber is formed as a fluid-tight chamber and is isolated from the heat-receiving chamber by a partition wall through which the heat is exchanged between the viscous fluid in the fluid-tight heat-generating chamber and the engine coolant (the heat exchanging fluid) in the heat-receiving chamber. The coolant is introduced into the heat receiving chamber through a water inlet port and delivered from the heat-receiving chamber toward an external heating system, and the water is constantly circulated through the heat generator and the external heating system.

A drive shaft is rotatably supported in the front housing via an anti-friction bearing so as to support thereon a rotor element in such a manner that the rotor element is rotated with the drive shaft within the fluid-tight heat-generating chamber. The rotor element has outer faces which are in face-to-face with the inner wall surfaces of the fluid-tight heat generating chamber and form therebetween a small gap in the shape of labyrinth grooves, and a viscous fluid, e.g., silicone oil, is supplied into the heat generating chamber so as to fill the small gap, i.e., the labyrinth grooves between the rotor element and the wall surfaces of the fluid-tight heat generating chamber.

When the drive shaft of the viscous fluid type heat generator incorporated in the vehicle heating system is driven by an engine of a vehicle via a solenoid clutch, the rotor element is rotated within the heat generating chamber so as to apply a shearing action to the viscous fluid held between the wall surfaces of the fluid-tight heat generating chamber and the outer faces of the rotor element. Thus, the viscous fluid (silicone oil) generates heat due to the shearing action applied thereto. The heat is transmitted from the viscous fluid to the coolant flowing through the heat-receiving chamber. The coolant carries the heat to the heating circuit of the vehicle heating system to heat an objective heated area, e.g., a passenger compartment of the vehicle.

In the described viscous fluid type heat generator, connection and disconnection of the solenoid clutch are conducted on the basis of a control signal indicating only the temperature of the coolant which must be always circulated through a water jacket of the vehicle engine for the purpose of cooling the vehicle engine. Therefore, when the temperature of the coolant is lower than a preset temperature value, the solenoid clutch is connected to drive the rotor element of the viscous fluid type heat generator. As a result, even if the temperature of the viscous fluid within the heat-generating chamber is excessively high, the viscous fluid is continuously subjected to the shearing action applied by the rotating rotor element. Thus, the viscous fluid, e.g., the silicone oil is thermally and mechanically degraded or deteriorated to reduce its heat-generating performance. It should be understood that an upper permissible temperature of the silicone oil is considered to be approximately 200° C., and if the temperature of the silicone oil exceeds the upper permissible temperature, the thermal degradation of the silicone oil and the mechanical degradation thereof due to an application of a shearing action easily occur.

Alternately, if connection and disconnection of the solenoid clutch between the vehicle engine and the drive shaft of the heat generator is conducted on the basis of a control signal indicating only a rotating speed of the vehicle engine per unit time (the rotating speed of the vehicle engine) and in turn a rotating speed of the rotor element per unit time (the rotating speed of the rotor element), it may be possible to eliminate the above-mentioned defect of the viscous fluid type heat generator of JP-A-2-246823. Then, as shown in FIG. 6, even when the temperature of the coolant is either at −40° C. or at 80° C., the solenoid clutch will be disconnected when the rotating speed of the vehicle engine, i.e., that of the rotor element is increased to a preset number. Thus, the shearing force is applied to the viscous fluid within the heat-generating chamber in direct connection with the rotating speed of the vehicle engine, and in turn that of the rotor element. Accordingly, even when the vehicle is continuously operated and runs at a given speed, the rotor element of the viscous fluid type heat generator driven by the vehicle engine, via the solenoid clutch, will be automatically disconnected from the vehicle engine as soon as the rotations of the rotor element exceeds the preset number to prevent the application of the shearing action to the viscous fluid by the rotor element, and the degradation of the viscous fluid can be avoided.

However, when the connection and disconnection of the solenoid clutch is conducted on the basis of the detection of the rotating speed of the vehicle engine and that of the rotor element, it occurs that the rotation of the rotor element is completely stopped due to the disconnection of the solenoid clutch, and heat generation by the viscous fluid is resultingly stopped even if an objective heated area is cold. Therefore, it becomes impossible to adjustably control the heat generating performance of the viscous fluid type heat generator. Thus, for example, when a vehicle is operated at such a given high speed that the rotating speed of the vehicle engine is far above the preset rotating speed of the rotor element of the viscous fluid type heat generator before the coolant has been sufficiently heated by the viscous fluid type heat generator, the solenoid clutch is left disconnected to thereby prevent transmission of the drive force from the vehicle engine to the rotor element of the viscous fluid type heat generator and, accordingly, the viscous fluid type heat generator cannot generate heat to be used for heating an objective heated area, e.g., a passenger compartment of the vehicle even if the heated area is cold.

SUMMARY OF THE INVENTION

Therefore, an object of the present invention is to solve the problems encountered by the conventional vehicle heating system employing a viscous fluid type heat generator as a subsidiary heat source.

Another object of the present invention is to provide a vehicle heating system incorporating therein a viscous fluid type heat generator and being able to prevent degradation of the heat generating performance of the viscous fluid within the viscous fluid type heat generator for an extended life of operation of the heat generator and surely achieving the heating of an objective heated area such as a passenger compartment of the vehicle while detecting the operating condition of the viscous fluid type heat generator.

A further object of the present invention is to provide a method of controlling the operation of a vehicle heating system incorporating therein a viscous fluid type heat generator in order to prevent the thermal and mechanical degradation of a viscous fluid confined in the heat generator and to achieve an effective heating of a heated area in a vehicle.

In accordance with one aspect of the present invention, there is provided a vehicle heating system which comprises:

a heat generator provided with a rotor element rotated by a drive source within a heat generating chamber forming therein a fluid-holding gap to hold therein a heat-generative fluid able to viscously generate heat to be transmitted to a heat exchangeable fluid which carries the heat to a heated area when a shearing force is applied to the heat-generative fluid by the rotating rotor element, the heat generator including a heat-generation adjusting means to adjustably vary heat-generating performance thereof;

a first detecting unit detecting a first control signal generated in response to a change in a rotating speed of the rotor element;

a control unit connected to said heat-generation adjusting means and said first detecting means, the control unit controlling the operation of the heat-generation adjusting means by comparing the first control signal receiving from the first detecting unit with a preset reference signal; and, a second detecting unit connected to said control unit to provide the control unit with a second control signal generated in response to a change in the fluid temperature of at least one of the heat-generative fluid and the heat exchangeable fluid, the control unit adjustably changing the preset reference signal when it receives the second control signal from said second detecting unit.

It should be understood that the first control signal detected by the first detecting unit is determined to be directly or indirectly generated in response to the change in the rotating speed of the rotor element. Thus, the first control signal can be a signal substantially indicating the strength of the shearing action applied to the heat-generative fluid by the rotating rotor element. Since the control unit is arranged to control the operation of the heat-generation adjusting means of the heat generator on the basis of the preset reference signal when it receives the first control signal from the first detecting unit, the heat-generation adjusting means can change the heat-generating ability of the heat-generative fluid confined in the fluid-holding gap in the heat generating chamber so as to increase or decrease the heat generation on the basis of the detected first control signal. Therefore, for example, when the vehicle incorporating therein the above-mentioned heating system is operated to run at a constant high speed so that the rotor element of the heat generator is rotated at the corresponding high speed, it is possible to adjustably reduce the heat-generation performance of the heat generator in order to prevent degradation in the thermal and mechanical heat-generating ability of the viscous heat-generative fluid.

On the other hand, when the vehicle is operated either under an idling condition of the vehicle engine due to e.g., in a traffic jam or to continuously run at a low speed, so that the rotor element of the heat generator is rotated at the corresponding low speed, it is possible to operate the heat-generation adjusting means so as to increase the heat-generating performance of the heat generator. As a result, the heating system can provide the objective heated area in e.g., a vehicle, with a required heated condition comfortable for passengers in the vehicle.

Further, the control unit is able to adjustably change the preset reference signal when it receives, from the second detecting unit, the second control signal in direct association with the temperature of the heat exchangeable fluid or that of the heat-generative fluid. Therefore, when the preset reference signal is changed, the heating system can either increase or decrease the heating performance of the heat generator on the basis of the changed preset reference signal in order to provide the heated area with an optimum heated condition. It should therefore be understood that the heating system of the present invention can adjustably change the heat-generating performance of the heat generator on the basis of the control signals detected in direct association with the operating parameters of the heat generator, not only the rotating speed of the rotor element but also other variables related to the operating condition of the heat generator. Therefore, when the temperature of the heat-generative fluid confined within the heat generator is excessively high, it is possible to decrease the heat-generating performance of the heat generator on the basis of the detection of the second control signal, so that application of the shearing action to the heat-generative fluid is reduced to thereby prevent the heat-generative fluid from being thermally and mechanically deteriorated.

On the other hand, for example, when the vehicle is operated to run at a high speed before the heat exchangeable fluid delivering from the heat generator is fully heated, it is possible to increase the heat-generating performance of the heat generator on the basis of the detection of the second control signal indicating the temperature of the heat exchangeable fluid so as to provide the objective heated area with a desired amount of heat comfortable for a passenger.

Preferably, the preset reference signal provided for the control unit in connection with the rotating speed of the rotor element should be adjustably changed on the basis of the second control signal so that as long as the temperature of the heat-generative fluid is kept within a predetermined permissible temperature range, the heat-generating performance of the heat generator is adjustably reduced at a rotating speed of the rotor element which is chosen to be lower depending on an increase in the temperature of the heat exchangeable fluid or that of the heat-generative fluid. The predetermined permissible temperature range of the heat-generative fluid could be a temperature range not exceeding e.g., the afore-mentioned 200° C. when the silicone oil is used as the heat-generative fluid.

When the heating system incorporates therein the heat generator driven by, for example, a vehicle engine without an interposition of a clutch device between the vehicle engine and the drive shaft of the heat generator, namely, when the heat generator of the heating system receives drive power via a belt and a pulley mounted on the drive shaft of the heat generator, the heating system can adjustably vary the heat-generating performance of the heat generator while omitting a connecting and a disconnecting operation of the clutch device. Therefore, a shock caused by the connecting and disconnecting of the clutch device is not generated and accordingly, the occupants in the vehicle can constantly have pleasant driving experience and enjoy a comfortable heated condition.

The heat-generation adjusting means of the heat generator incorporated in the heating system of the present invention may include a signal-responsive actuator unit having a controlling element operable to adjustably change an amount of the viscous fluid in the fluid-holding gap formed in the heat generating chamber. Alternatively, the heat-generation adjusting means may include a signal-responsive actuator unit having a controlling element operable to adjustably change an extent of the fluid-holding gap formed in the heat-generating chamber.

Preferably, the heat-generative fluid confined in the heat generator is a silicone oil, and the heat exchangeable fluid is an engine coolant when the heating system is applied to an engine-driven vehicle.

In accordance with another aspect of the present invention, there is provided a method of controlling the operation of the heating system incorporating therein a heat generator provided with a rotor element rotated by a drive source within a heat generating chamber forming therein a fluid-holding gap to hold therein a heat-generative fluid capable of generating heat to be transmitted to a heat exchangeable fluid which carries the heat to a heated area when a shearing force is applied to the heat-generative fluid by the rotating rotor element, the heat generator including a heat-generation adjusting means for adjustably varying heat-generating performance of the heat generator, the method comprises the steps of:

providing a control unit with a preset reference signal with respect to a rotating speed of at least one of the drive source and said rotor element of the heat generator;

detecting an actual rotating speed of at least one of the drive source and the rotor element to generate a first control signal to be supplied to the control unit;

calculating an actuation control signal by the control unit on the basis of the first control signal and the preset reference signal; and supplying the actuation control signal to the heat-generation adjusting means to thereby control an actuation of the heat-generation adjusting means.

Preferably the method further comprises the steps of:

detecting a temperature of at least one of the heat-generative fluid and the heat exchangeable fluid to generate a second control signal to be supplied to the control unit; and adjustably changing the preset reference signal set in the control unit on the basis of the second control signal.

Further preferably, the calculating step comprises:

comparing the first control signal with the preset reference signal to determine whether the first control signal is smaller than the preset signal; and generating an externally applied signal as the actuation control signal to actuate the heat-generation adjusting means when the first control signal is smaller than the preset reference signal.

BRIEF DESCRIPTION OF THE DRAWINGS

The above and other objects, features, and advantages of the present invention will be made more apparent from the ensuing description of preferred embodiments with reference to the accompanying drawings wherein.

DESCRIPTION OF THE PREFERRED EMBODIMENTS

Figure 1:
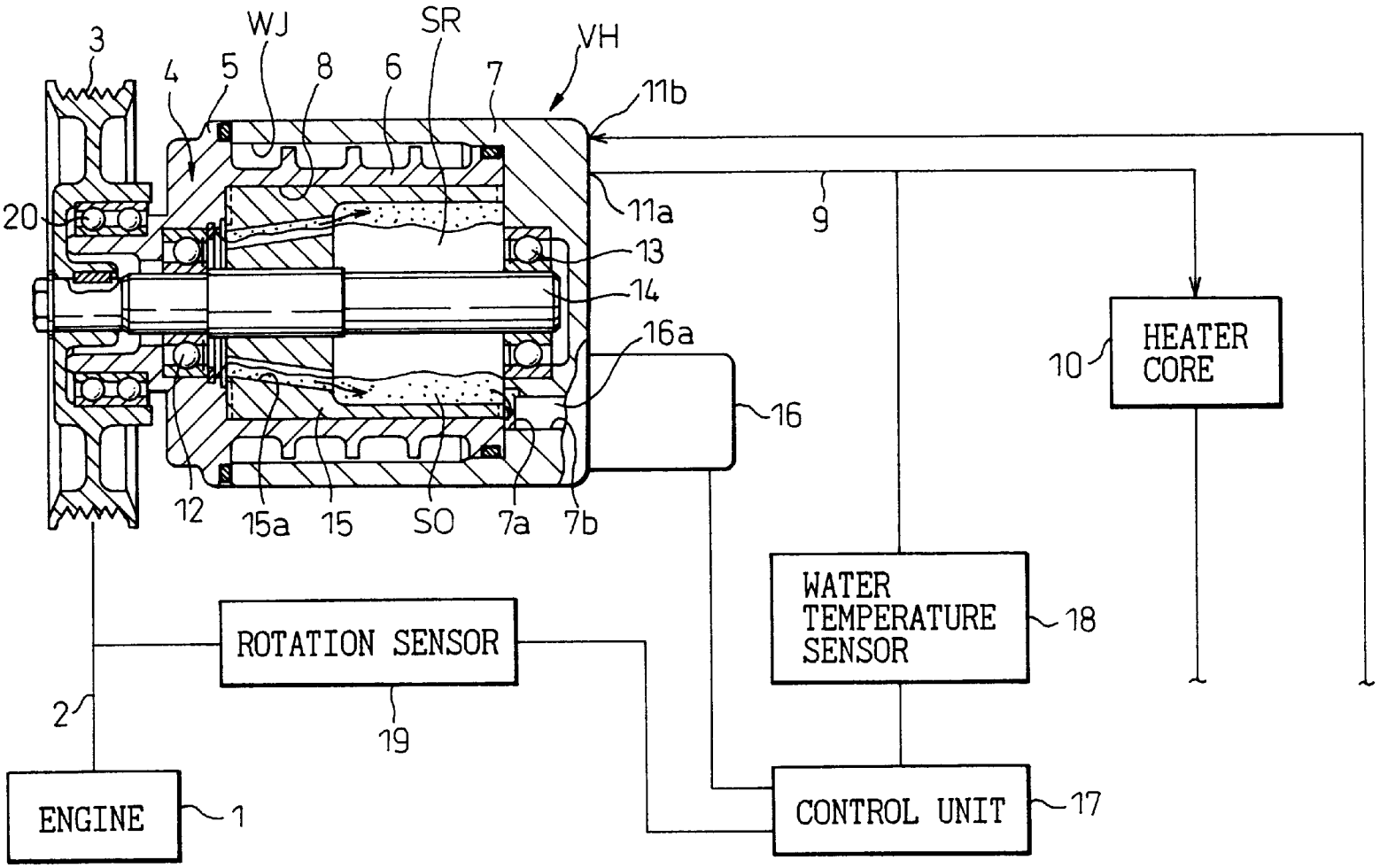
FIG. 1 is a schematic block diagram illustrating a construction and an arrangement of a vehicle heating system according to a first embodiment of the present invention.

Referring to FIG. 1, a vehicle heating system according to a first embodiment of the present invention includes a viscous fluid type heat generator VH. The viscous fluid type heat generator VH is arranged to be connected, via a pulley 3 and a belt 2, to an engine 1 for driving a vehicle. The viscous fluid type heat generator VH is further provided with a front housing 4 having a flange 5 and a tubular portion 6 which extends axially rearward from the flange 5 and defines a cylindrical cavity therein enclosed by a cylindrical inner wall. A cup-like rear housing 7 is assembled on the front housing 4 so that a connecting portion between the flange 5 and an extreme end of the rear housing 7 and that between a rearmost end of the tubular portion 6 and an inner bottom end of the rear housing 7 are sealed by O-rings, respectively. The cylindrical cavity of the tubular portion 6 of the front housing 4 is formed as a heat generating chamber 8 when the rearmost end of the tubular portion 6 is closed by a bottom end wall of the rear housing 7. The cup-like rear housing 7 further defines a heat receiving chamber WJ in the form of a water jacket extending around an outer surface of the tubular portion 6 and an end face of the flange 5 of the front housing 4. A heat-generative viscous fluid e.g., a silicone oil "SO", and a given amount of air are confined within the heat generating chamber 8, and a heat exchanging fluid, e.g., a coolant is permitted to flow through the heat receiving chamber WJ. Namely, the heat receiving chamber WJ is connected, via an outlet port 11*a* provided for the heat generator VH, to a fluid conduit 9 which extends through a heat core 10 and a water jacket (not shown) of the engine 1 to a fluid inlet port 11*b* provided for the viscous fluid type heat generator VH.

Bearings 12 and 13 are housed in the front and rear housings 4 and 7 and rotatably support the drive shaft 14 extending through the heat-generating chamber 8. The drive shaft 14 has an outermost end to which the afore-mentioned pulley 3 is fixedly connected to be rotatable together with the drive shaft 14 via a bearing 20 mounted on an frontmost end of the front housing 4.

The drive shaft 14 has a middle portion thereof on which a cup-like rotor element 15 is press-fitted so that the rotor element 15 is rotated within the heat generating chamber 8. The cup-like rotor element 15 has a front and a rear end face and a cylindrical outer circumference, and these front and rear end faces and the outer circumference confront axially front and rear end faces and radially the cylindrical inner wall of the heat generating chamber 8 to define a fluid-holding gap to hold the heat-generative viscous fluid. The cup-like rotor element 15 also has an inner cylindrical cavity formed as a fluid storing chamber SR in which the heat-generative viscous fluid is stored to be prevented from being subjected to a shearing action due to the rotation of the rotor element 15. The cup-like rotor element 15 further has a base portion fixed to the drive shaft 14, and provided with one or more through-holes 15*a* which axially extend from a front end to a rear end of the base portion of the rotor element 15. The through-holes 15*a* are inclined outwardly from the front end to the rear end thereof and, open toward the fluid storing chamber SR.

The rear housing 7 is provided with an arcuate channel 7*a* recessed in the bottom end wall thereof which axially confronts the rearmost end of the rotor element 15 at a lower portion of the bottom end wall. The arcuate channel 7*a* is fluidly connected to an axial through-channel 7*b* bored through the wall of the rear housing 7 so as to have an opening in the outer end face of the rear housing 7. The arcuate channel 7*a* and the axial through-channel 7*b* are provided for fluidly interconnecting the fluid storing chamber SR and the above-mentioned fluid-holding gap and, can contribute to adjustably varying the heat-generating performance of the heat generator VH by adjusting an amount of the heat-generative viscous fluid held in the fluid-holding gap, as described later. Namely, the arcuate channel 7*a* and the axial through-channel 7*b* are indispensable for constituting a heat-generation adjusting means of the viscous fluid type heat generator VH.

The viscous fluid type heat generator VH is provided with an actuator 16 attached to the outer end face of the rear housing 7 and accommodating therein a signal-controlled solenoid (not shown in FIG. 1) and a slidable valve element 16*a* which slides in the axial through-channel 7*b* in response to the energizing and the de-energizing of the solenoid. The actuator 16 constitutes the heat-generation adjusting means in cooperation with the afore-mentioned arcuate channel 7*a* and the axial through-channel 7*b* provided in the rear housing 7. The signal-controlled solenoid of the actuator 16 is connected to a control unit 17 to control the operation of the vehicle heating system in which the viscous fluid type heat generator VH is incorporated.

The control unit 17 is also connected to a rotation sensor 19 which acts as a first detecting unit to detect the rotating speed of the engine 1, and in turn the rotating speed of the rotor element 15 of the viscous fluid type heat generator VH. Thus, the control unit 17 receives a signal indicating the rotating speed of the rotor element 15 from the rotation sensor 19.

The control unit 17 is further connected to a water temperature sensor 18 which acts as a second detecting unit to detect the temperature of the coolant flowing through the fluid conduit 9.

In the described vehicle heating system of the first embodiment, the viscous fluid type heat generator VH generates heat when the rotor element 15 is rotationally driven by the engine 1 via the belt 2, the pulley 3, and the drive shaft 14 to be rotated within the heat generating chamber 8. Namely, when the rotor element 15 is rotated in the heat generating chamber 8, the viscous fluid is subjected to a shearing action and accordingly, frictionally generates heat. The generated heat is transmitted to the coolant flowing through the heat receiving chamber WJ, so that the coolant carries the heat to the heat core 10 by which the heat is presented to an objective heated area such as a passenger compartment of the vehicle and to the engine 1 to warm up it when the engine 1 is cold.

Figure 2:
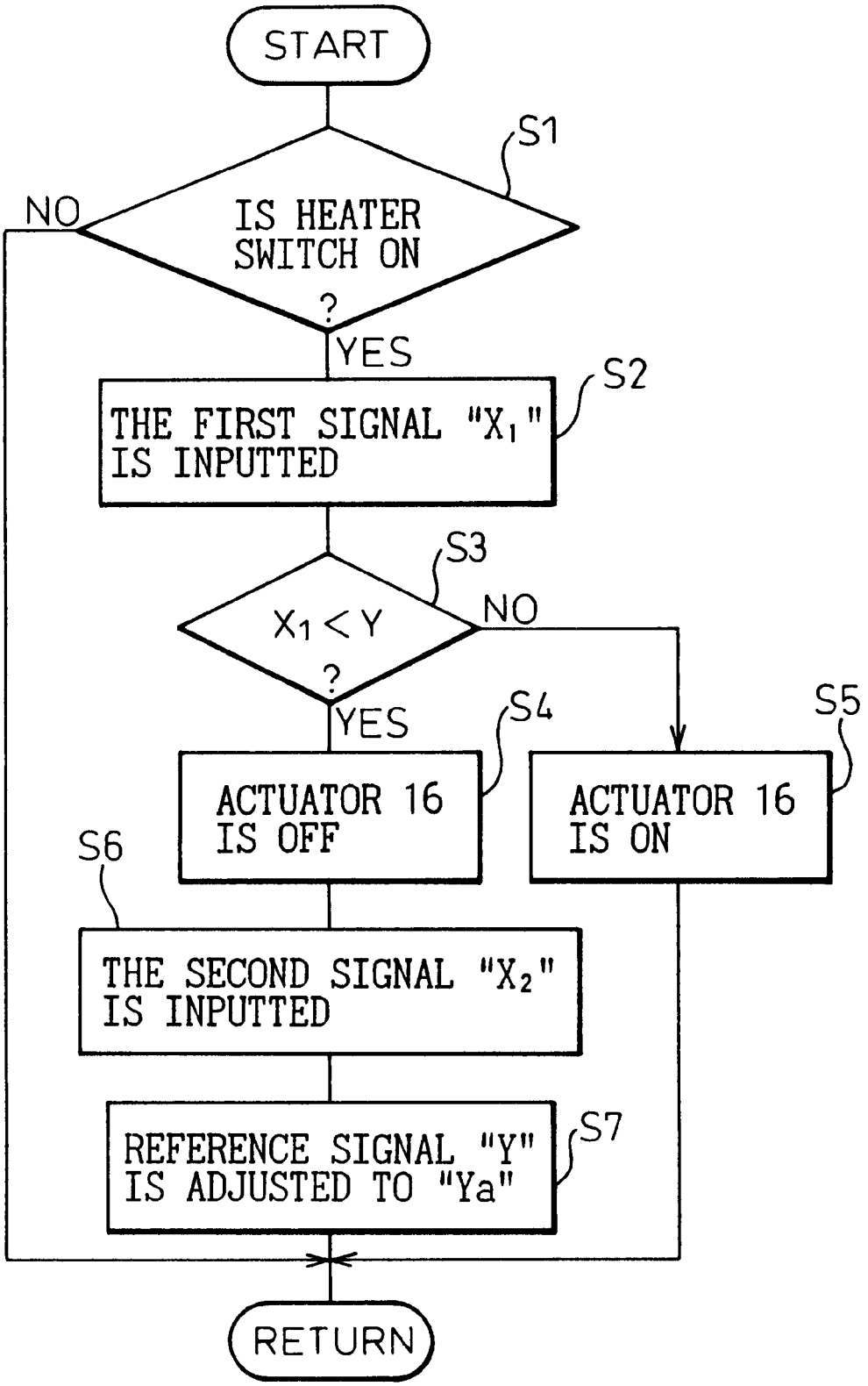
FIG. 2 is a flow chart illustrating a method of controlling the operation of the vehicle heating system of the first embodiment of the present invention.

In a vehicle in which the vehicle heating system of the first embodiment is assembled, when the engine 1 of the vehicle is started by the operation of an engine key (not shown), the control unit 17 starts to perform a signal processing operation as depicted in FIG. 2. The description of the signal processing operation of the control unit 17 is provided below with reference to FIG. 2.

In the step S1, the control unit 17 makes a judgement as to whether or not one of the occupants of the vehicle, e.g., a driver, has operated to switch the vehicle heating system ON by using a predetermined heater switch (not shown). When the operation of the heater switch to ON is judged to be "YES", the operation of the control unit 17 is proceeded to the step S2. When the operation of the heater switch to ON is judged to be "NO", the operation of the control unit 17 goes to "RETURN".

In the step S2, a first signal $X_1$ is inputted to the control unit 17 by the rotation sensor 19, which is generated on the basis of the rotating speed of the engine 1, and in turn, the rotating speed of the rotor element 15. It should be noted that the use of the first signal $X_1$ directly or indirectly indicating the rotating speed of the rotor element 15 by the control unit 17 is based on the fact that the rotating speed of the rotor element 15 directly affects on an extent of shearing action applied to the viscous fluid held in the viscous fluid type heat generator VH.

In the subsequent step S3, the control unit 17 compares the first signal $X_1$ inputted by the rotation sensor 19 with a reference signal Y (e.g., reference value $Y_0$) which is preliminarily set in the control unit 17. When the first signal $X_1$ is smaller than the preset reference signal Y ($Y_0$), it is understood that the rotation of the rotor element 15 has not yet been increased to a speed which might cause degradation in the heat-generating performance of the silicone oil "SO" due to an application of a large shearing action to the silicone oil "SO". Thus, the operation of the control unit 17 is proceeded to the step S4. At this stage, since the solenoid of the actuator 16 is de-energized to rearwardly withdraw the slidable valve element 16*a* within the axial through-channel 7*b*, the arcuate channel 7*a* and the axial through-channel 7*b* provide an extended fluid communication channel between the fluid storing chamber SR and the fluid-holding gap around the rotor element 15 via the open rear end of the rotor element 15. Therefore, the heat-generative viscous fluid is easily supplied from the fluid storing chamber SR into the fluid-holding gap around the rotor element 15 via the open rear end of the rotor element 15 by the centrifugal force acting on the viscous fluid due to the rotation of the rotor element. The rotation of the rotor element 15 further applies a centrifugal effect to the viscous fluid in the inclined through-holes 15*a* of the rotor element 15, so that the viscous fluid flows from fluid-holding gap back into the fluid storing chamber SR. Accordingly, a circulatory movement of the viscous fluid through the fluid storing chamber SR, the arcuate channel 7*a*, the fluid-holding gap, and the through-holes 15*a* occurs when the slidable valve element 16*a* is held at its withdrawn position. Thus, the viscous fluid actively generates heat in the fluid-holding gap around the rotor element 15 due to the application of the shearing action by the rotating rotor element 15 to the viscous fluid. The heat is then effectively transmitted to the coolant in the heat-receiving chamber WJ due to the heat exchange. Namely, the heat-generating performance of the viscous fluid type heat generator VH is increased. During the heat generating operation of the viscous fluid type heat generator VH, the operation of the control unit 17 proceeds to the subsequent step S6.

On the other hand, in the step S3, when the first signal $X_1$ is judged to be larger than reference signal Y ($Y_0$) it is detected that the rotation of the rotor element 15 has been fully increased to provide the viscous fluid in the fluid-holding gap with a large shearing action which might cause degradation in the heat-generating performance of the viscous fluid. Thus, the operation of the control unit 17 proceeds to the step S5. Therefore, the solenoid of the actuator 16 is energized to advance the slidable valve element 16*a* forwardly into the axial through-channel 7*b*. Thus, the front end of the slidable valve element 16*a* is projected into the arcuate channel 7*a* to reduce the area of path of the arcuate channel 7*a*, and accordingly, a fluid communication between the fluid storing chamber SR and the fluid-holding gap around the rotor element 15 is reduced, so that the centrifugal supply of the viscous fluid from the fluid storing chamber SR into the fluid-holding gap via the open rear end of the rotor element 15 is reduced. Therefore, an amount of circulation of the viscous fluid through the fluid storing chamber SR, the arcuate channel 7*a*, the heat-generating chamber 8, and the inclined through-holes 15*a* is reduced. Thus, the viscous fluid cannot be subjected to an active shearing action within the fluid-holding gap around the rotor element 15, and accordingly, heat generation by the viscous fluid is reduced to result in a reduction of heat to be transmitted to the coolant flowing through the heat receiving chamber WJ. Namely, the heat-generating performance of the viscous fluid type heat generator VH is decreased. Therefore, for example, when the vehicle is operated to constantly run at a high speed so as to continuously rotate the rotor element 15 of the viscous fluid type heat generator VH at a corresponding high speed, the heat-generating performance of the viscous fluid type heat generator VH can be suppressed to prevent the heat-generating property of the viscous fluid from being degraded by the shearing action applied by the rotor element 15 within the fluid-holding gap. The operation of the control unit 17 becomes "RETURN" as shown in FIG. 2 to return to the first step S1.

Figure 3:
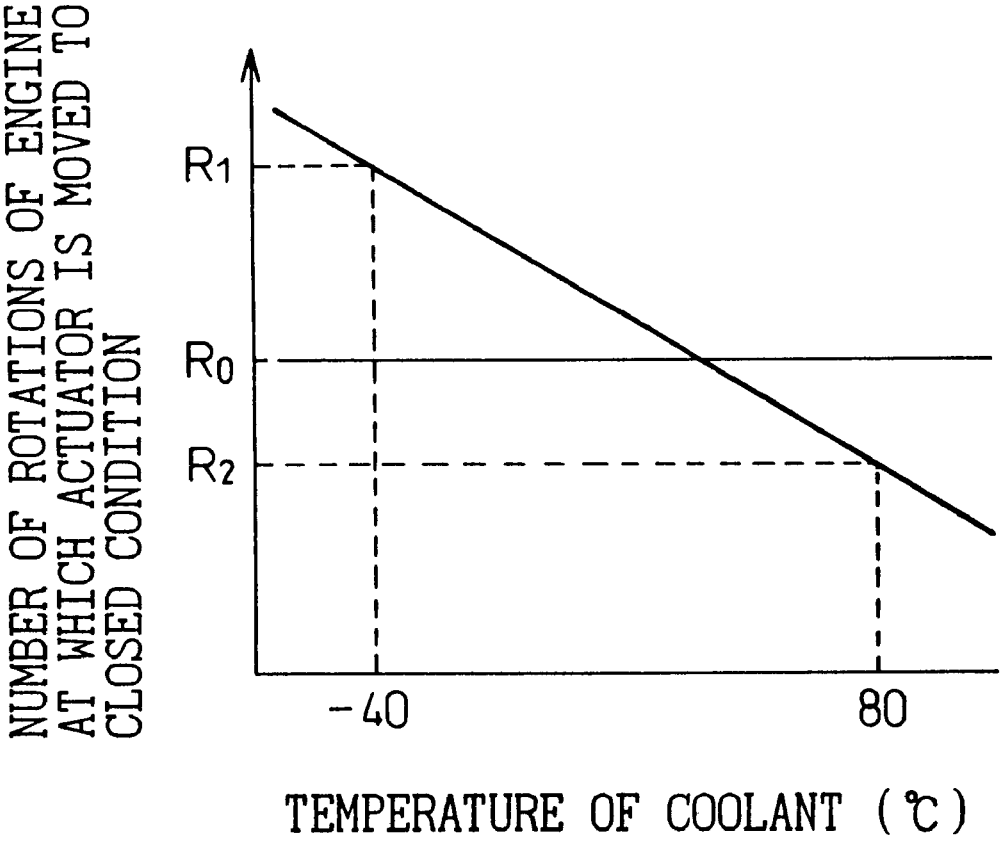
FIG. 3 is a graph indicating a relationship between the rotating speed of a vehicle engine at which an actuator unit of a viscous fluid type heat generator is moved to a closed condition and the temperature of a coolant circulating through the vehicle heating system of the first embodiment.

From the above-described operation of the control unit 17, it should be understood that, as indicated in the graph of FIG. 3, whatever temperature the coolant has, between −40° C. and 80° C., when the rotating speed of the engine 1, and in turn, that of the rotor element 15 increases to a preliminarily set rotating speed "R0", the slidable valve element 16*a* of the actuator 16 is forwardly advanced to obtain a reduction in a fluid communication between the fluid storing chamber SR and the fluid-holding gap around rotor element 15.

On the other hand, in the step S6 of FIG. 2, a second signal $X_2$, generated on the basis of the temperature of the coolant flowing through the fluid conduit 9 and detected by a water temperature sensor 18, is inputted to the control unit 17. Then, the operation of the control unit 17 proceeds to the step S7. In the step S7, when the second signal $X_2$ is inputted to the control unit 17, the control unit 17 implements an adjustment of the preset reference signal Y. Namely, the detected temperature of the coolant is higher under a condition such that the temperature of the viscous fluid is kept within a predetermined permissible temperature range, the control unit 17 adjustably changes the preset reference signal Y (the reference rotating speed $Y_0$) to a lower rotating speed Ya. Thus, the operation of the actuator 16 due to the energizing and de-energizing of the solenoid is controlled on the basis of the adjusted preset reference signal Y (Ya), i.e., the lower rotating speed Ya.

When the adjustment of the preset reference signal Y is completed, the operation of the control unit 17 becomes "RETURN" to return to the initial step S1. As a result, the operation of the control unit 17 in the step S3 is implemented on the basis of the adjusted preset reference signal Y (Ya). Namely, the first signal $X_1$ is compared with the adjusted reference signal Ya.

After the adjustment of the reference signal Y to Ya is performed, as shown in FIG. 3, when the temperature of the coolant is kept at e.g., −40° C., the actuator 16 is energized to advance the slidable valve element 16*a* into the axial through-channel 7*b* when the rotating speed of the engine 1, and in turn, that of the rotor element 15 of the viscous fluid type heat generator 15 is increased to the number R1. When the temperature of the coolant is kept at e.g., 80° C., the actuator 16 is energized to advance the slidable valve element 16*a* into the axial through-channel 7*b* when the rotating speed of the engine 1, and in turn, that of the rotor element 15 of the viscous fluid type heat generator 15 is increased to the number R2 which is smaller than R1.

From the foregoing description, it will be understood that the vehicle heating system of the first embodiment can reduce its heat-generating performance on the basis of not only the rotating speed of the rotor element 15 but also of a different variable parameter, typically the temperature of the coolant which is not in direct connection with the rotating speed of the rotor element 15. Therefore, the vehicle heating system of the first embodiment of the present invention and the controlling method for the operation of the same system can surely achieve prevention of degradation in the heat-generating property of the viscous fluid confined in the viscous fluid type heat generator VH and a desired heating of the objective heated area in the vehicle.

Further, in the vehicle heating system of the first embodiment, the drive shaft 14 of the viscous fluid type heat generator VH is rotationally driven by the engine 1 of the vehicle via only the belt and pulley 3 while employing no clutch device such as a magnetic clutch. Thus, the rotor element 15 mounted on the drive shaft 14 is constantly rotated when the vehicle engine 1 is in operation. Accordingly, the operation of the vehicle heating system does not provide any adverse affect such as a change in a load due to connecting and disconnecting of the clutch, on the operation of the engine 1 and, therefore, a pleasant driving experience can be obtained during the running of the vehicle.

In the described heating system of the first embodiment, the second signal indicating the temperature of the coolant (the heat exchanging fluid) may alternatively be a signal indicating either the temperature of the viscous fluid or that of the front or rear housing 4 or 7 which is indirectly indicative of the temperature of the coolant.

Figure 4:
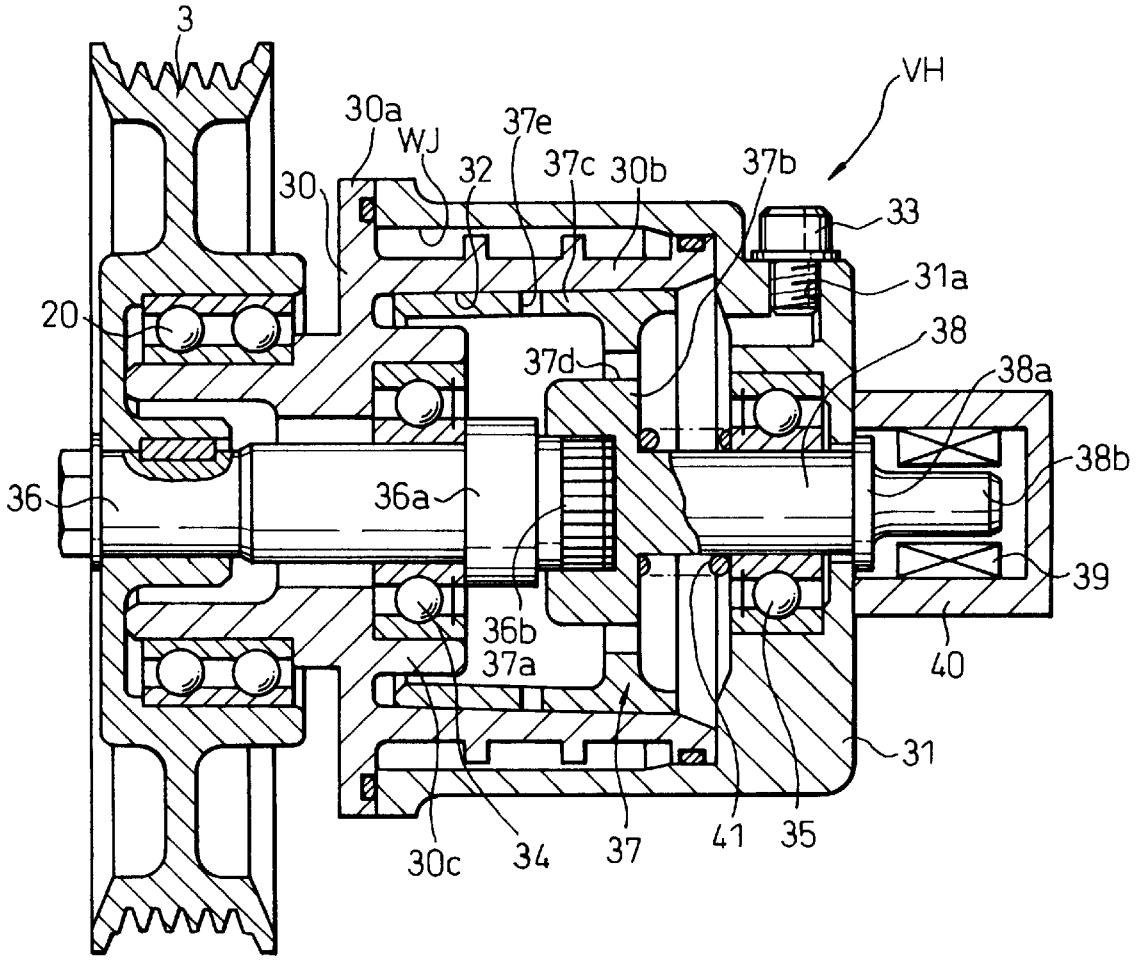
FIG. 4 is a longitudinal cross-sectional view of a viscous fluid type heat generator according to a second embodiment of the present invention.

FIG. 4 illustrates a viscous fluid type heat generator to be used for constructing a vehicle heating system according to a second embodiment of the present invention.

The viscous fluid type heat generator VH of FIG. 4 is provided with a heat-generation adjusting unit capable of adjustably changing the heat-generating performance of the heat generator VH on the basis of increasing or decreasing an extent of the fluid-holding gap. More specifically, the viscous fluid type heat generator VH includes a front housing 30 provided with a flange 30*a* and a tubular portion 30*b* extending rearwardly from the flange 30. The tubular portion 30*b* of the front housing 30 is formed to have a cylindrical and axially conical inner wall the diameter of which is increased toward the rear end of the tubular portion 30*b*.

The viscous fluid type heat generator VH of FIG. 4 is also provided with a cup-like rear housing 31 which is fitted over the front housing 30. The rear housing 31 has a front end connected to the flange 30*a* via a sealing element consisting of an O-ring and an inner bottom end portion connected to a portion of the rear end of the tubular portion 30*b* via a sealing element consisting of an O-ring. Thus, the cylindrical and axially conical inner wall of the tubular portion 30*b* of the front housing 30 forms a generally cylindrical heat generating chamber 32 closed by the rear housing 31. A rear end face of the flange 30*a* and an outer circumference of the tubular portion 30*b* of the front housing 30 forms a heat receiving chamber WJ in the form of a water jacket in cooperation with an inner wall of the cup-like rear housing 31. The rear housing 31 is provided with a fluid-filling hole 31*a* through which a silicone oil, i.e., a viscous fluid is filled in the heat-generating chamber 32. The fluid filling hole 31*a* is closed and sealed by a screw bolt 33 when the filling of the viscous fluid is completed. The heat receiving chamber WJ is fluidly connected to a fluid circuit for a heat exchange fluid via fluid inlet and fluid outlet ports (not shown) which are formed in e.g., the rear housing 31. Namely, the heat exchanging fluid is circulated through the heat receiving chamber WJ and the fluid circuit to carry heat from the viscous fluid type heat generator VH to a heater core similar to the heater core 10 of the first embodiment.

The front housing 30 is further provided with a cylindrical inner boss 30*c* formed to be coaxial with the tubular portion 30*b* and housing therein a front bearing 34. A rear bearing 35 is housed in the rear housing 31 to be coaxial with the front bearing 34. The front bearing 34 rotatably supports an axial drive shaft 36 having a middle large-diameter portion 36*a* and a splined portion 36*b* arranged on the rear side of the large-diameter portion 36*a*. A rotor element 37 is axially slidably mounted on the splined portion 36*b* of the drive shaft 36 to be rotated together with the drive shaft 36 within the heat-generating chamber 32. Namely, the rotor element 37 is provided with a radially central base portion 37*b* having a central splined bore 37*a* axially slidably engaged with the splined portion 36*b* of the drive shaft 36, and an outer tubular portion 37*c* extending frontwardly from the central base portion 37*b* within the heat generating chamber 32. The outer tubular portion 37*c* has a generally cylindrical and axially conical outer circumference to be complement with the conical inner wall of the tubular portion 30*b* of the front housing 30. Thus, the diameter of the outer circumference of the outer tubular portion 37*c* increases from the front end toward the rear end thereof.

The central base portion 37*b* of the rotor element 37 is provided with one or more axial communication holes 37*d* to provide a fluid communication between a portion of the heat generating chamber 32 located ahead the front face of the central base portion 37*b* and another portion of the heat generating chamber 32 located behind the rear face of the central base portion 37*b*.

The tubular portion 37*c* of the rotor element 37 is provided with one or more radial communication holes 37*e* to provide a fluid communication between a portion of the heat generating chamber 32 located outside the tubular portion 37*c* and that located inside the tubular portion 37*c*.

The rotor element 37 is further provided with a support shaft 38 integral with the central base portion 37*b* and axially project rearwardly in a direction opposite to the drive shaft 36. The support shaft 38 is rotatably supported by the rear bearing 35 and having a later-described iron core portion 38*b*.

A solenoid casing 40 is fixedly connected to the rear housing 31 to receive therein a solenoid 39, a flange 38*a* and the above-mentioned iron core 38*b*. The flange 38*a* is formed at an end of the support shaft 38, and the iron core 38*b* extends from the flange 38*a* to be extended into the center of the solenoid 39. The flange portion 38*a* is axially movable together with the support shaft 38 between the outer end of the rear housing 31 and the solenoid 39, and the axial movement of the flange 38*a* is caused by the movement of the iron core 38*b* which are magnetically moved by the solenoid 39 which is energized and de-energized in response to an externally supplied control signal. The solenoid 39 is electrically connected to a control unit (not shown) similar to the control unit 17 of the first embodiment of FIG. 1.

A coil spring 41 is arranged between the central base portion 37*b* and the bearing 35 to constantly urge the rotor element 37 toward the drive shaft 36. It should be noted that the tubular portion 30*b* of the front housing 30, the outer tubular portion 37*c*, the solenoid 39 and the iron core 38*b* constitute a heat-generation adjusting unit, and the other construction and arrangement of the viscous fluid type heat generator VH is similar to those of the viscous fluid type heat generator VH incorporated in the vehicle heating system of the first embodiment.

In the vehicle heating system incorporating therein the above-described viscous fluid type heat generator VH, when the solenoid 39 is de-energized, the rotor element 37 is moved frontward by the spring force of the coil spring 41. Therefore, the inner wall of the tubular portion 30*b* of the front housing 30 and the outer circumference of the outer tubular portion 37*c* of the rotor element 37 cooperate to define a reduced fluid-holding gap and, accordingly, the heat-generating performance of the heat generator VH is increased.

When the solenoid 39 is energized, the iron core 38*b* integral with the rotor element 37 is magnetically attracted by the solenoid 39 to be moved rearwardly against the spring force of the coil spring 41. Therefore, the outer circumference of the outer tubular portion 37*c* of the rotor element 37 is moved away from the inner wall of the tubular portion 30*b* of the front housing 30 to increase an extent of the fluid-holding gap. Thus, the heat-generating performance of the viscous fluid type heat generator VH is reduced.

It will be understood that the vehicle heating system of the second embodiment incorporating therein the viscous fluid type heat generator VH of FIG. 4 is able to reduce the heat-generating performance of the heat generator VH on the basis of not only the rotating speed of the rotor element 37 but also the temperature of the coolant circulating through the vehicle heating system, which is detected as a signal not directly based on the speed of the rotor element 37. Thus, the vehicle heating system of the second embodiment can prevent the viscous fluid confined in the viscous fluid type heat generator from being thermally and mechanically degraded for a long operation life of the heating system, and can surely achieve heating of an objective heated area such as a passenger compartment of a vehicle.

Figure 5:
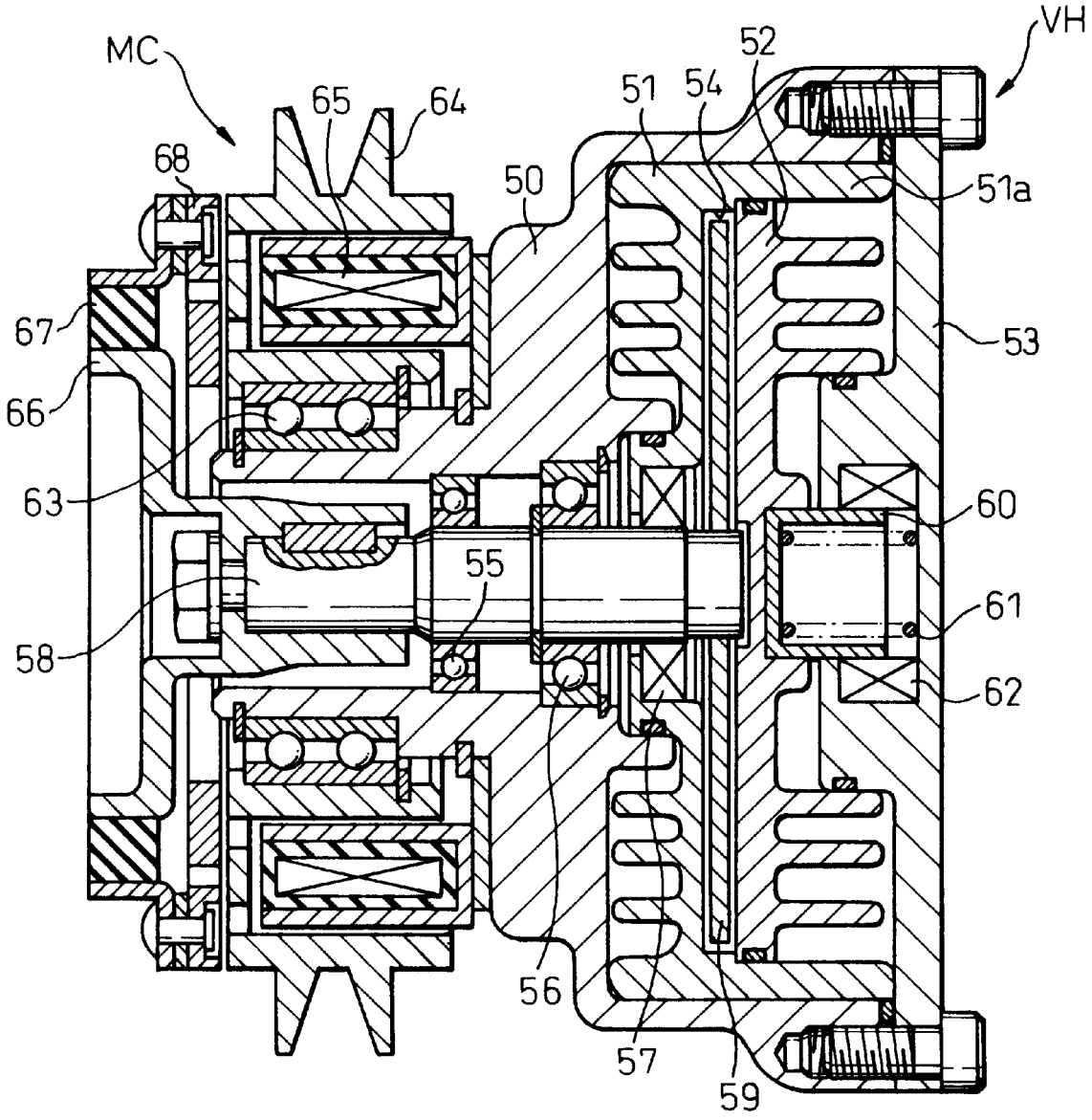
FIG. 5 is a longitudinal cross-sectional view of a viscous fluid type heat generator according to a third embodiment of the present invention.
Figure 6:
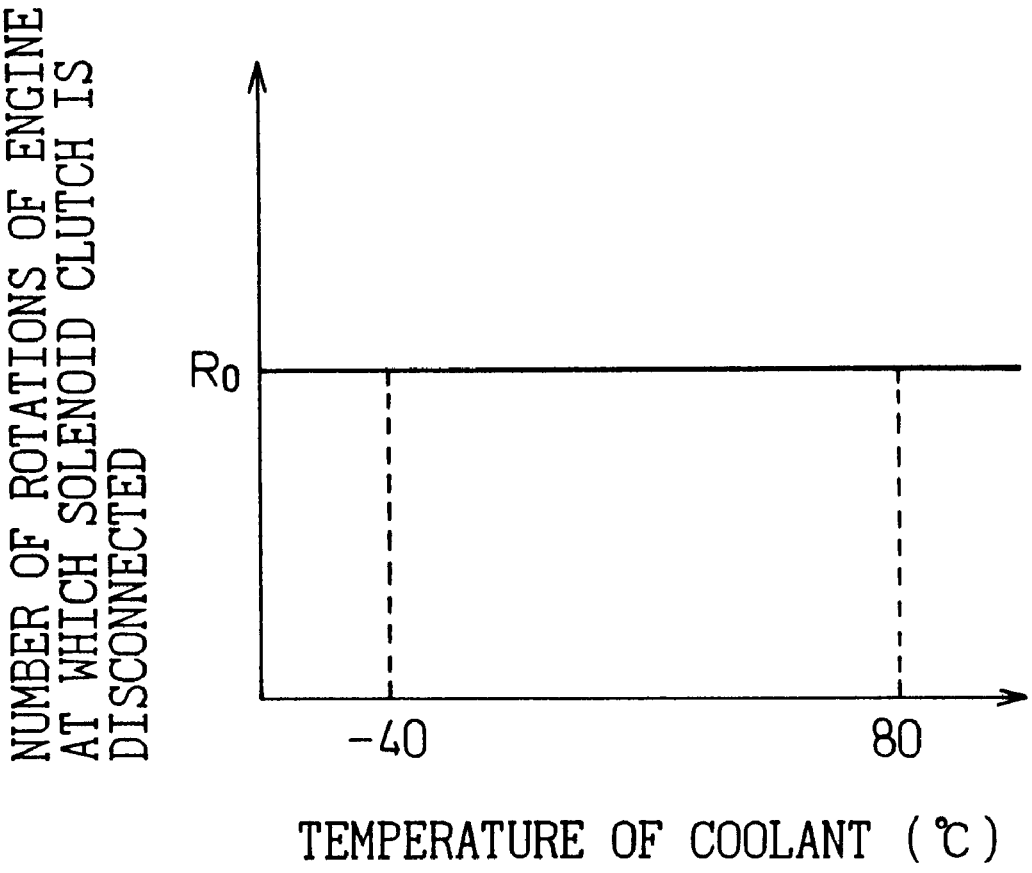
Fig.6 (PRIOR ART)
FIG. 6 is a graph indicating a relationship between the rotating speed of a vehicle engine at which a solenoid clutch of a viscous fluid type heat generator incorporated in a vehicle heating system of the prior art is disconnected and the temperature of a coolant circulating through the vehicle heating system.

FIG. 5 illustrates a different type of viscous fluid type heat generator VH used as a heat-generative source incorporated in a vehicle heating system according to a third embodiment of the present invention.

Referring to FIG. 5, a viscous fluid type heat generator is provided with a heat-generation adjusting unit capable of adjustably changing a heat generating performance thereof and includes a cup-like front housing 50 in which a front plate member 51 and a rear plate member 52 are housed and arranged to axially confront each other. A rear open end of the front housing 50 is closed by a plate-like rear housing 53. The front plate 51 has a cylindrical boss 51*a* at its circumferential portion, which extends rearwardly to form a cylindrical cavity therein. The rear plate member 52 is fitted in the cavity of the cylindrical boss 51*a* of the front plate member 51 to be axially slidable along an circular inner wall of the cylindrical boss 51*a* in front and rear directions. The front and rear plate members 51 and 52 define therebetween a closed heat-generative chamber 54 in which a viscous fluid generates heat when it is subjected to a shearing force. The front housing 50 and the front plate member 51 define a front heat receiving chamber WJ1, and the rear housing 53 and the rear plate member 52 define a rear heat receiving chamber WJ2. The front and rear heat receiving chambers WJ1 and WJ2 are commonly provided with an inlet port and an outlet port (not shown in FIG. 5) via which the two chambers WJ1 and WJ2 fluidly communicate with a fluid circulating circuit of the vehicle heating system to circulate a coolant (heat exchanging fluid) in order to carry heat from the viscous fluid type heat generator VH to an objective heated area in a manner similar to the first and second embodiments.

The front housing 50 holds therein axially spaced bearing devices 55 and 56 by which a drive shaft 58 is rotatably supported. The drive shaft 58 has an inner end axially extending into the heat-generative chamber 54 to support thereon a plate-like rotor element 59. The rotor element 59 is arranged to be able to axially slide on the inner end of the drive shaft 58. A portion of the drive shaft 58 located adjacent to the inner end thereof is sealed by a shaft seal device 57 held by the front plate member 51.

The viscous fluid type heat generator VH is further provided with a cylindrical spring seat member 60 substantially centrally press-fitted in the rear plate member 52 to receive a coil spring 61 arranged between a bottom face of the spring seat member 60 and an inner face of the rear housing 53. The cylindrical spring seat member 60 is axially slidably received by the rear housing 53. Namely, the sliding movement of the spring seat member 60 together with the rear plate member 52 is magnetically caused by a solenoid 62 which is energized and de-energized by an externally supplied control signal. The solenoid 62 is accordingly connected to a control unit similar to the control unit 17 (FIG. 1) of the first embodiment.

It should be understood that the front plate member 51, the rotor element 59, the rear plate member 52, the rear housing 53, the spring seat member 60 and the solenoid 62 cooperate together to constitute a heat-generation adjusting unit of the viscous fluid type heat generator VH.

The viscous fluid type heat generator VH of the present embodiment is constructed to be connected to a drive source, e.g., a vehicle engine, via a magnetic clutch MC mounted on the front housing 50 and the drive shaft 58. The magnetic clutch MC is provided with a pulley 64 mounted on the front housing 50 via a bearing device 63 to be rotatable about the axis of the bearing device 63, and a solenoid 65 housed in a receiving recess formed in the pulley 64. The solenoid 65 is electrically connected to the control unit of the vehicle heating system. The magnetic clutch MC is further provided with a hub member 66 fixedly connected, at its central portion, to the outer end of the drive shaft 58 and also connected, at its periphery, to an armature element 68 via an annular elastic rubber member 67. The pulley 64 is operatively connected to a vehicle engine via a drive belt in the same manner as the vehicle heating system of FIG. 1. The other construction and arrangement of the vehicle heating system of the present embodiment is similar to those of the afore-mentioned first and second embodiments.

In the vehicle heating system of the third embodiment accommodating therein the viscous fluid type heat generator VH of FIG. 5, when the solenoid 62 housed in the rear housing 53 is de-energized, the rear plate member 52 is moved forward by the spring force exhibited by the coil spring 61. Thus, the rear face of the front plate member 51, the front and rear faces of the rotor element 59, and the front face of the rear plate member 52 reduce the fluid-holding gap in the heat-generating chamber 54 so as to increase the heat-generating performance of the heat generator VH.

On the other hand, when the solenoid 62 is energized, the cylindrical spring seat member 60 is magnetically attracted by the solenoid 62 to move in a rearward direction and, accordingly, the rear plate member 52 is moved rearward so as to increase the fluid-holding gap between the rear face of the rotor element 59 and the front face of the rear plate member 52. Accordingly, there appears a pressure differential in the viscous fluid, i.e., the silicone oil held in the fluid-holding gap between the rear face of the front plate member 51 and the front face of the rotor element 59 and that held in the fluid-holding gap between the rear face of the rotor element 59 and the front face of the rear plate member 52. Therefore, the rotor element 59 is moved rearward by the pressure differential to totally increase the fluid-holding gap in the heat-generating chamber 54. Consequently, the heat-generating performance of the viscous fluid type heat generator VH is decreased. Namely, controlling of the heating performance of the vehicle heating system of the third embodiment is achieved by adjustably changing the heat-generating performance of the heat generator VH.

It should be noted that, in the vehicle heating system of the third embodiment, when a vehicle occupant, e.g., a driver turns on a heater switch (not shown) on a vehicle's control panel, the magnetic clutch MC is energized so as to connect the pulley 64 to the drive shaft 58 of the viscous fluid type heat generator VH. On the contrary, when the vehicle occupant turns off the heater switch, the magnetic clutch MC is de-energized to disconnect the pulley 64 from the drive shaft 58.

It should further be noted that, in the vehicle heating system of the third embodiment, it is possible to adjustably change (or reduce) the heat-generating performance of the viscous fluid type heat generator VH in response not only to a change in the rotating speed of the rotor element 59 but also to a change in the temperature of the coolant which is not directly associated with the rotating speed of the rotor element 59. Therefore, the same controlling method of the operation of the vehicle heating system as that applied to the first and second embodiments can be applied.

From the foregoing description of the preferred embodiments, it will be understood that the present invention can provide a heating system accommodating therein a viscous fluid type heat generator employing a viscous fluid, typically a silicone oil, especially a vehicle heating system capable of surely preventing degradation of the viscous fluid confined in the viscous fluid type heat generator for a long life of operation of the vehicle heating system and satisfactorily achieving a heat-application performance to an objective heated area such as a vehicle passenger compartment.

It should further be understood that many and various changes and modifications will occur to a person skilled in the art without departing from the scope and spirit of the invention as claimed in the accompanying claims.

What we claim is:

1. A heating system comprising:

a heat generator provided with a rotor element rotated by a drive source within a heat generating chamber forming therein a fluid-holding gap to hold therein a heat-generative fluid able to viscously generate heat to be transmitted to a heat exchangeable fluid which carries the heat to a heated area when a shearing force is applied to the heat-generative fluid by the rotating rotor element, said heat generator including a heat-generation adjusting means to adjustably vary the heat-generating performance thereof;

a first detecting unit detecting a first control signal generated in response to a change in a rotating speed of the rotor element;

a control unit connected to said heat-generation adjusting means and said first detecting unit, said control unit controlling the operation of said heat-generation adjusting means by comparing the first control signal receiving from said first detecting unit with a preset reference signal; and, a second detecting unit connected to said control unit to provide said control unit with a second control signal generated in response to a change in the fluid temperature of at least one of the heat-generative fluid and the heat exchangeable fluid, said control unit adjustably changing the preset reference signal when it receives the second control signal from said second detecting unit.

2. The heating system according to claim 1, wherein the preset reference signal set in said control unit in connection with the rotating speed of said rotor element is adjustably changed on the basis of the second control signal so that as long as the temperature of the heat-generative fluid is kept within a predetermined permissible range, the heat-generating performance of said heat generator is adjustably reduced at a rotating speed of said rotor element which is selected lower depending on an increase in the temperature of the heat exchangeable fluid or that of the heat-generative fluid.

3. The heating system according to claim 1, wherein said heat-generation adjusting means of said heat generator comprises a signal-responsive actuator unit having a controlling element operable to adjustably change an amount of the heat-generative fluid in said fluid-holding gap formed in said heat generating chamber.

4. The heating system according to claim 3, wherein said signal-responsive actuator unit comprises a solenoid-incorporated actuator including a retractably extendable valve element as said controlling element, said retractably extendable valve element being able to control a circulating amount of the heat-generative fluid passing through said fluid-holding gap of said heat generator.

5. The heating system according to claim 1, wherein said heat-generation adjusting means comprises a signal-responsive actuator unit having a controlling element operable to adjustably change an extent of said fluid-holding gap formed in said heat-generating chamber.

6. The heating system according to claim 5, wherein said signal-responsive actuator comprises a solenoid-operated actuator which includes a signal-responsive solenoid, a spring-biased iron core member movable in response to an energizing and de-energizing of said solenoid, said spring-biased iron core member being able to move said rotor element to thereby change said extent of said fluid-holding gap.

7. The heating system according to claim 5, wherein said signal-responsive actuator comprises a solenoid-operated actuator which includes a signal-responsive solenoid, a spring-biased iron core member movable in response to an energizing and de-energizing of said solenoid, said spring-biased iron core member being movable to reduce a volume of said heat-generating chamber to thereby change said extent of said fluid-holding gap.

8. The heating system according to claim 1, wherein said rotor element of the heat generator is constantly connected to said drive source without an interposition of any clutch unit.

9. The heating system according to claim 1, wherein said heated area is at least a passenger compartment of a vehicle.

10. The heating system according to claim 9, wherein said drive source comprises a vehicle engine to which said rotor element of said heat generator is connected via a belt-pulley mechanism and wherein said heat exchangeable fluid is an engine coolant.

11. The heating system according to claim 1, wherein said heat generator comprises a viscous fluid type heat generator which uses a silicone oil as said heat-generative fluid.

12. A method of controlling the operation of a heating system incorporating therein a heat generator provided with a rotor element rotated by a drive source within a heat generating chamber forming therein a fluid-holding gap to hold therein a heat-generative fluid capable of generating heat to be transmitted to a heat exchangeable fluid which carries the heat to a heated area when a shearing force is applied to the heat-generative fluid by the rotating rotor element, said heat generator including a heat-generation adjusting means for adjustably varying a heat-generating performance of said heat generator, the method comprises the steps of:

providing a control unit with a preset reference signal with respect to a rotating speed of at least one of said drive source and said rotor element of said heat generator;

detecting an actual rotating speed of at least one of said drive source and said rotor element to generate a first control signal to be supplied to said control unit;

calculating an actuation control signal by said control unit on the basis of said first control signal and said preset reference signal; and supplying said actuation control signal to said heat-generation adjusting means to thereby control an actuation of said heat-generation adjusting means.

13. The method according to claim 12, further comprises the steps of:

detecting a temperature of at least one of the heat-generative fluid and said heat exchangeable fluid to generate a second control signal to be supplied to said control unit; and adjustably changing said preset reference signal set in said control unit on the basis of said second control signal.

14. The method according to claim 12, wherein said calculating step comprises:

comparing said first control signal with said preset reference signal to determine whether said first control signal is smaller than said preset signal; and generating an externally applied signal as said actuation control signal to actuate said heat-generation adjusting means when said first control signal is smaller than said preset reference signal.

* * * * *